US005211125A

United States Patent [19]

Garland et al.

[11] Patent Number: 5,211,125

[45] Date of Patent: May 18, 1993

[54] APPARATUS AND METHOD FOR PERFORMING EXTERNAL SURFACE WORK ON SHIPS' HULLS

[75] Inventors: Charles Garland, Williamsburg; Richard A. Goldbach; Frank E. McConnell, both of Norfolk; James A. McMichael, Chesapeake; William A. Wagner, Virginia Beach, all of Va.

[73] Assignees: Metro Machine Corporation, Norfolk; Tidewater Equipment Corporation, Chesapeake, both of Va.

[21] Appl. No.: 782,315

[22] Filed: Oct. 24, 1991

[51] Int. Cl.[5] ..... B63B 59/00

[52] U.S. Cl. ..... 114/222; 15/1.7

[58] Field of Search ..... 114/222; 15/53.1, 53.2, 15/53.3, 1.7

[56] References Cited

U.S. PATENT DOCUMENTS

| | | | |
|---|---|---|---|
| 783,276 | 2/1905 | Hughes . | |
| 821,776 | 5/1906 | Zoller . | |
| 3,149,438 | 9/1964 | Morley et al. | 51/8 |
| 4,232,487 | 11/1980 | Brown | 51/425 |
| 4,375,740 | 3/1983 | Brown | 51/425 |
| 4,395,850 | 8/1983 | Brown | 51/427 |
| 4,658,749 | 4/1987 | Penalba | 114/222 |
| 4,782,844 | 11/1988 | Hughes | 114/222 |
| 4,784,078 | 7/1988 | Feurt | 114/222 |
| 4,825,598 | 5/1989 | Schlick | 51/410 |
| 4,890,567 | 1/1990 | Caduff | 114/222 |
| 5,007,210 | 4/1991 | Urakami | 114/222 |
| 5,038,527 | 8/1991 | Fastje | 51/426 |

OTHER PUBLICATIONS

Aerial photograph of ship repair facility of Metro Machine Corporation, Norfolk, Virginia.

EPA report regarding cleaning and painting of ship' hulls.

*Primary Examiner*—Jesus D. Sotelo

*Assistant Examiner*—Stephen P. Avila

*Attorney, Agent, or Firm*—Cushman, Darby & Cushman

[57] ABSTRACT

For cleaning and/or painting the exterior of a ship hull while the ship is in dry dock, one or more staging devices are provided. Each includes a metal framework tower supporting a vertically movable elevator assembly that comprises a trolley, from which a variably laterally projecting platform is supported on articulated, cantilevered arms. Adjustable, non-porous shrouds enclose a volume of space between the outside of the tower and an increment of one side of the exterior of the ship hull, from above, fore, aft and outside. Cleaning and painting operations are conducted from the platform on the hull increment, and debris is removed from the dry-dock deck area enclosed by the shroud, after which the device is moved by crane, typically twenty feet (6.1 m), towards the ship's bow or stern. The shrouds are then adjusted so that a further hull increment can be worked on. The trolley and extension-retraction of the platform support arms are operated by electrohydraulic winch and hydraulic cylinders, respectively. The margins of the shroud may be fastened by magnets to the hull. Air drawn through the enclosed volume from above, is drawn out near the dry-dock deck for processing to remove dust and appropriately treat VOCs, if present.

27 Claims, 8 Drawing Sheets

APPARATUS AND METHOD FOR PERFORMING EXTERNAL SURFACE WORK ON SHIPS' HULLS

BACKGROUND OF THE INVENTION

Ship's hulls are very large and are complexly contoured in both the vertical and longitudinal directions. The world's population of ships has a very significant number of different sizes and shapes.

Coating of the exteriors of ships requires using abrasive blasters for surface preparation and painters for application of paint. Both blasters and painters must be brought into close proximity to the portion of the hull they are working. Neither blasters nor painters can perform their work on much more than 75 square feet of hull surface without moving or being moved to another location.

In earlier times, worker movement from place to place around a ship's hull was accommodated by building staging around the ship.

More recently, this movement has been accomplished through the use of manlifts. A conventional manlift includes a staging basket mounted on an arm which has the capability of being hydraulically lifted, extended and rotated; this arm being mounted on a carriage powered by an internal combustion engine. The carriage has the capability of being moved from place to place on a horizontal surface.

Even more recently for abrasive blasting, efforts have been made to replace the worker in the manlift basket, with an enclosed shotblast head which has the capability of catching, processing and reusing the abrasive. However, this approach has had little acceptance because of the cost to purchase and operate the apparatus, plus operating difficulties with the devices actually available.

Since ships are very large vessels which operate on large bodies of water, their construction and repair by dry-docking almost always takes place immediately adjacent to large bodies of water.

Pollution of these large bodies of water including Great Lakes, rivers, seas, bays and oceans has become a much greater concern to societies around the world because of the negative effect of this pollution on the vegetable and animal life which depend upon these bodies of water. This concern has grown as more of the public elects to use these bodies of water for recreation through swimming and boating as well as living adjacent to them in hotels, houses, apartments and condominiums.

Abrasive blasting of a ship's hull necessarily creates a significant quantity of particulate material, usually dust comprised in part of smaller particles of the abrasive medium as it breaks down upon being propelled pneumatically against the ship's hull and in part of small particles of the ship's paint and steel which is removed by the abrasive. While this dust is not currently officially considered to be hazardous, it is nevertheless noxious to the public and does contain toxins in apparently nonhazardous quantities.

Because a portion of this dust inevitably is blown over the adjacent body of water, small quantities of these toxins find their way into the water. Further, if the large percentage of the spent abrasive which lands on the dry dock floor is not promptly cleaned up, trace amounts of the toxins leach out during rainstorms or from other sources of water used in ship repair and are deposited into the body of water from the dry dock's drainage system. Toxic petroleum products including fuels, lubricants and greases associated with manlift operations can similarly be carried through the dry-dock drainage system into the adjacent body of water.

Typically, a ship has a large quantity of exterior mechanical equipment. This equipment, which is expensive to repair and purchase, is subject to severe damage if infiltrated by the dust from abrasive blasting, which is itself very abrasive. This mechanical equipment, which includes interior ventilation systems, must be temporarily covered with protective covering during abrasive blasting. This temporary covering prevents the interior ventilation systems from being operated or repaired when abrasive blasting is underway.

Virtually all the equipment required for abrasive blasting has mechanical components. This includes air compressors, manlifts, forklifts, dust collectors and dry-dock cranes. Since this equipment must operate during abrasive blasting, it cannot be protected. It therefore experiences very high maintenance cost, extensive out-of-service periods, and shortened operating life.

Coatings on dry-dock horizontal surfaces experience short lives as they are abraded off by the combination of spent abrasive and vehicular and personnel movement, including that which accompanies shoveling and sweeping.

Workers who are free to proceed with exterior ship construction and/or repair tasks which do not involve mechanical ship's components are disrupted, made less efficient and exposed to respiratory and eye aggravation when abrasive blasting is proceeding concurrently. Workers and ship's personnel transiting through the abrasive dust cloud to and from the interior of the ship are similarly affected.

Most ships operate in a corrosive saltwater/spray environment. Therefore, the most popular marine paints are solvent-based vinyls and epoxies. Some marine paints contain zinc or cooper. During the time that these paints are being applied, overspray is often blown into the adjacent body of water. This same overspray can coat itself on nearby boats, buildings, waterside cafes and cars, causing expensive damage and infuriating the public. Even the portion of the overspray which lands on the dry-dock floor can find its way back into the adjacent body of water as it attaches itself to dust or dirt particles on the floor of the dry dock which are washed by water through the dry dock's drainage system.

Nonwater-based paint solvents common in marine coatings release volatile organic compounds (VOCs) into the atmosphere during the time that they are evaporating, during the paint curing process. Regulatory authorities are becoming increasingly concerned that these VOCs are damaging the environment. While VOC emissions from marine paints may not be apparent to the public, they are a matter of growing regulatory oversight, and likely will ultimately have to be reduced. The only current way to dispose of these invisible VOCs is to contain the air into which they are released, and then process that air through a VOC incinerator.

Best management practices being currently utilized to minimize the amount of abrasive dust and paint overspray being blown beyond the dry-dock perimeter include placing a curtain over each end of the dry dock, performing abrasive blasting downward only, using airless paint spray equipment, and ceasing operations when wind velocities become higher than a predetermined limit. However, these practices nevertheless permit a significant percentage of the airborne abrasive dust and paint overspray to blow to outside of the perimeter of the dry dock. In addition, these practices do nothing to reduce the many other negative affects of the ship coating process.

Recently, some shipyards have begun shrouding ships, from the weather deck down to the dry-dock structure, with very large strips of material. This material must be somewhat porous to keep it from shredding in the wind. However, the lives of these large strips of material are short because of damage from wind, handling, errant abrasive blasting and other hazards inherent to the heavy industrial environment prevalent in shipyards. Because of the basic cost of the shrouding material itself, its short life in the shipyard environment, the cost of installing, removing, handling and storing it, this approach is very expensive. While this approach contains even more airborne abrasive dust and paint overspray within the dry-dock perimeter than currently accepted best management practices, some still escapes through the necessarily porous material and through the joints where the strips of material overlap. In addition, this approach does little to solve the many other negative effects of the ship coating process.

One other existing technology exists that reduces dust from sandblasting, that is the technology of vacuum blasting. However, this process is very slow and very costly, from an equipment and manpower standpoint.

With regard to approaches to resolve the many problems associated with the coating of ships, as expensive as the coating process is or may become, the major cost consideration is the speed with which a ship may be coated or recoated. This is because of the daily amortization and operation costs of the dry dock required to lift the ship out of the water for recoating ($5,000 to $20,000 U.S. per day) and the ship itself which is out of service during recoating ($10,000 to $100,000 U.S. per day). These costs demand that with whatever solutions are developed to solve the existing problems with abrasive blasting and coating of ships, elapsed time of the coating process be of the essence.

SUMMARY OF THE INVENTION

Apparatus and a method are provided for performing external surface work, including cleaning and/or painting, which largely overcomes the above-described shortcomings in the apparatus and methods that heretofore have been proposed or made available.

In practicing the invention, an enclosed ship staging device is provided and used, which has sufficient freedom of motion to permit full worker access to a ship's hull and also has the capability of containing abrasive blast dust, spent abrasive, paint overspray and volatile organic compounds (VOCs), thereby significantly reducing the quantities of these materials which are released to contaminate the air, nearby bodies of water, ship's mechanical equipment, dry-dock cranes, abrasive blasting and painting support mechanical equipment, local housing, automobiles, nearby yachts and other floating vessels, and thus significantly reducing the efforts necessary to collect, dispose of, recycle and incinerate waste abrasive and paint residue and significantly reducing the disruption of other concurrent shipboard repair work, all without increasing the dry-dock utilization times or ship out-of-service times.

For cleaning and/or painting the exterior of a ship hull while the ship is in dry dock, one or more staging devices are provided. Each includes a metal framework tower supporting a vertically movable elevator assembly that comprises a trolley, from which a variably laterally projecting platform is supported on articulated, cantilevered arms. Adjustable, non-porous shrouds enclose a volume of space between the outside of the tower and an increment of one side of the exterior of the ship hull, from above, fore, aft and outside. Cleaning and painting operations are conducted from the platform on the hull increment, and debris is removed from the dry-dock deck area enclosed by the shroud, after which the device is moved by crane, typically twenty feet (6.1 m), towards the ship's bow or stern. The shrouds are then adjusted so that a further hull increment can be worked on. The trolley and extension-retraction of the platform support arms are operated by electrohydraulic winch and hydraulic cylinders, respectively. The margins of the shroud may be fastened by magnets to the hull. Air drawn through the enclosed volume from above, is drawn out near the dry-dock deck for processing to remove dust and appropriately treat VOCs, if present.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
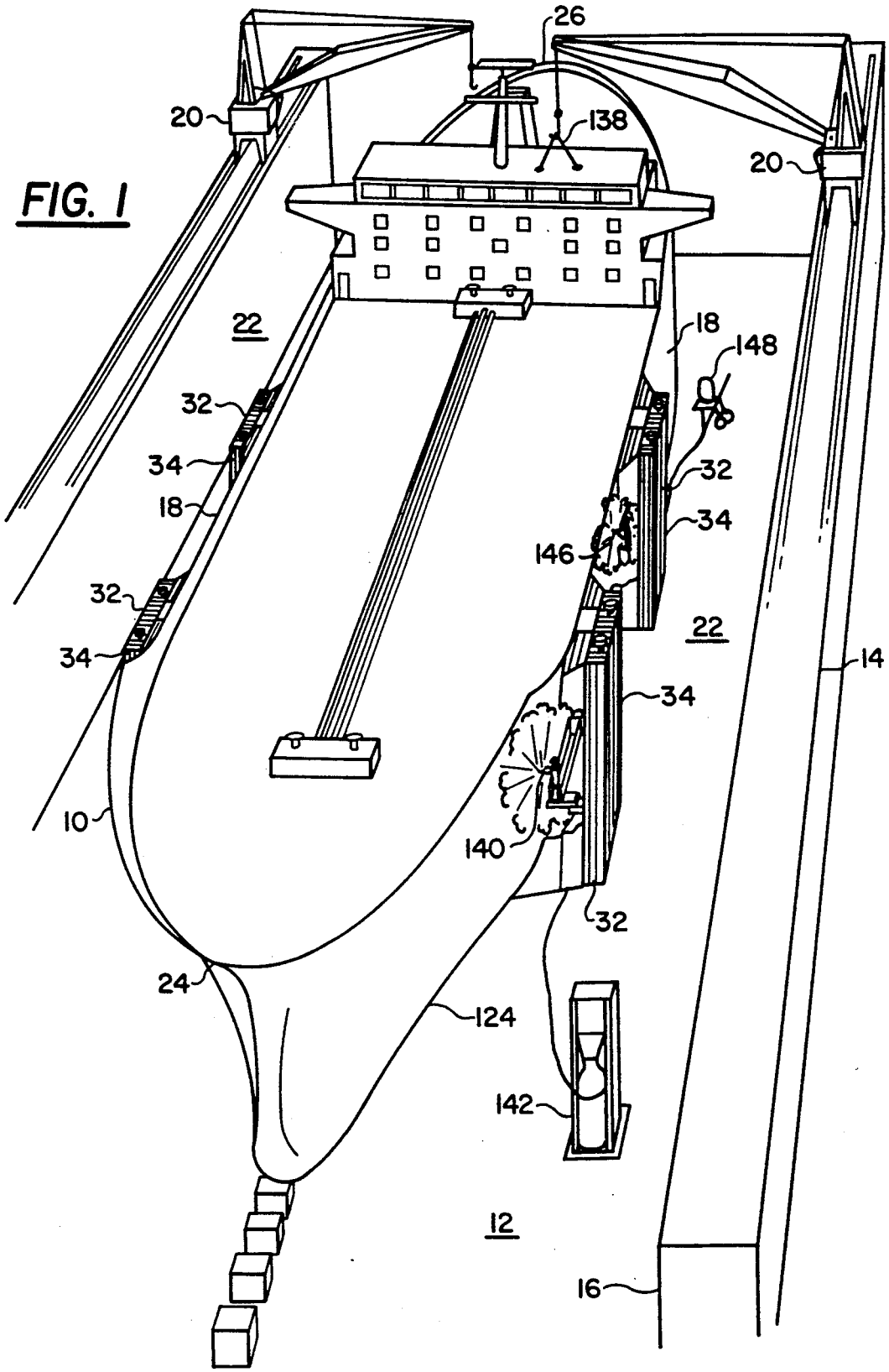
FIG. 1 is a pictorial view, from above, of a ship in dry dock, showing four ship staging devices provided in accordance with principles of the invention, being used for conducting enclosed cleaning and painting operations on a respective four increments, on two sides, of the exterior of the ship hull, the shroud on the device in the foreground being shown partly broken away so as to show the operation in progress. The dry-dock crane which can be used for moving the devices to address successive increments of the hull should be noted.
Figure 2:
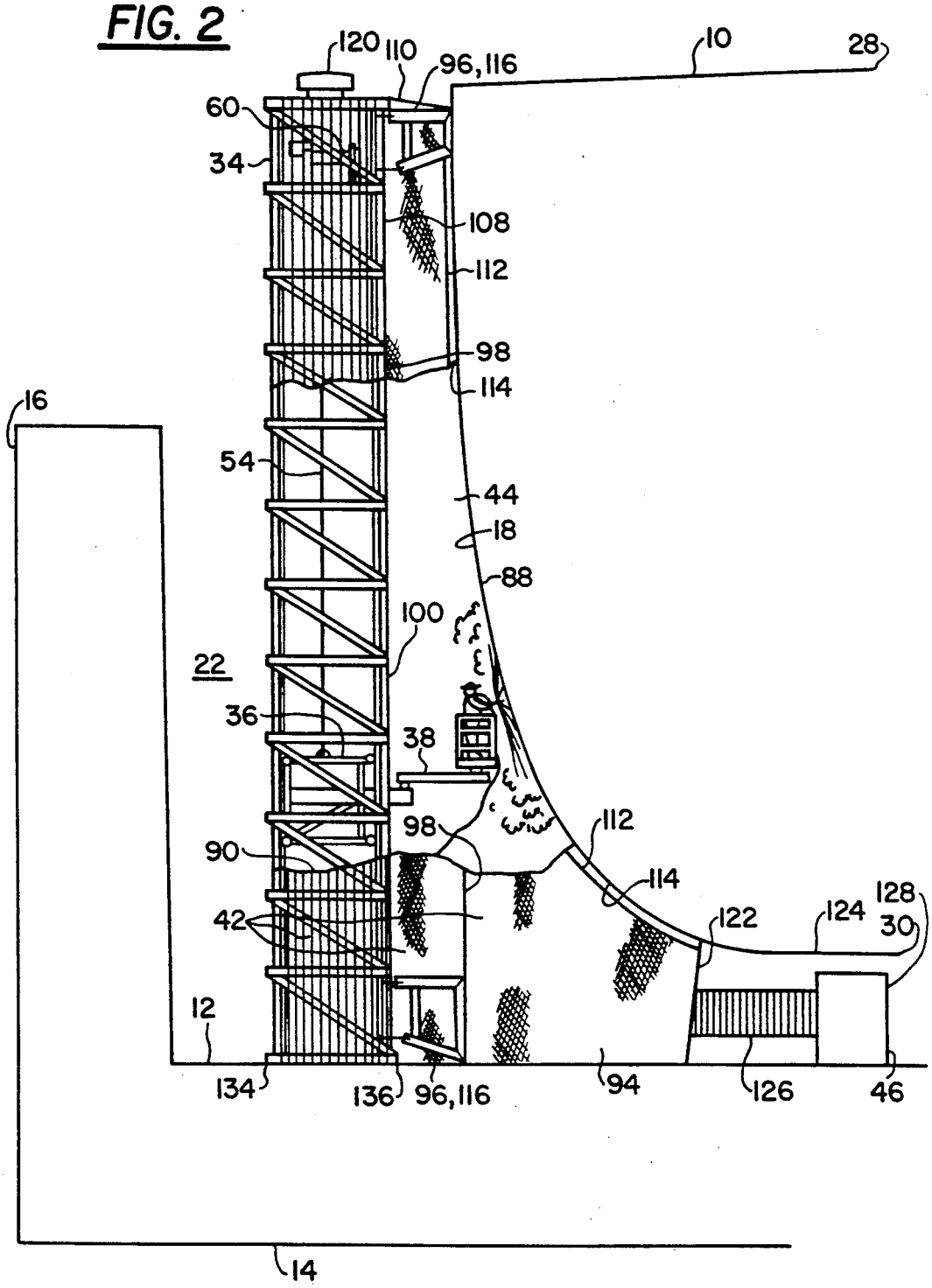
FIG. 2 is a side elevation view of one of the ship staging devices of FIG. 1, on a larger scale.

A typical ship is shown at 10 in FIGS. 1 and 2, supported on the pontoon deck 12 of a dry dock 14 which has upstanding wingwalls 16 that spacedly flank the two opposite sides 18 of the exterior of the hull of the ship. The dry dock 14 typically includes a conventional crane 20, which is typically used for moving parts and supplies to and from the ship, and for shifting the locations of apparatus which are used for performing various fitting and repair functions in relation to the ship. The crane 20 therefor is capable of placing and shifting apparatus at any selected location (e.g., in the alleys 22 between the wingwall and hull) on each side of the ship, between the ship bow 24 and ship stern 26.

A conventional ship hull has its maximum width dimension from the fore and aft centerline of the ship, at its weather deck that is usually located approximately midway along the length of the ship (midships). At any given location along the length of a ship, the distance of the hull from the fore and aft centerline tends to progressively reduce in the downward direction, between the weather deck height 28 and the keel height 30. Forward and aft of midships, the distance of the hull from the fore and aft centerline at any selected vertical height tends to further reduce progressively, until the minimum dimension is reached at keel height at the bow and stern (normally zero). Along given twenty-foot length (longitudinal) increments, most hulls have compound curvature in which the width dimension of the hull from the fore and aft centerline at greater distances below the weather deck reduces more quickly at locations further from midships.

The present invention provides one or more enclosed staging devices 32 which ca be used for performing work on the exterior of the ship hull while the ship is in dry dock. Typically, the ship is a used ship that has come in for maintenance, repairs, and/or refitting. Thus, there may be other work needing to be done, relatively simultaneously, to interior, deck and superstructure parts of the ship, as the apparatus and method of the present invention are being used in connection with work being done on the outside of the ship hull. Typically, the work to be done on the outside of the ship hull principally includes abrading-away of debris, corrosion, marine encrustations, scale, old coatings, and applying new coatings, typically by spraying. (In this document, such coatings are generically sometimes referred to as being "painted", without regard to whether a coatings specialist might use that term more restrictively.) Whether one or a plurality of the devices 32 are used will depend on the size of the ship, how quickly the work must be done, and the size of the workforce. Whether one size or two or more differently sized devices 32 are used, may depend on how radically the sides of the hull slope inwardly at various sites along the hull. (That is, in some instances, it may be more advantageous to reach certain areas using a smaller, supplemental device, or a different technique, such as vacuum blasting, than to construct the device 32 so as to be able to cantilever its platform to an extremely extended disposition.)

In very general terms, each enclosed staging device 32 includes a vertical tower 34 which is shiftably supported in an alley 22 on the deck of the dry dock, a trolley 36 which can be raised and lowered in the tower and stationed at a selected height, a set of cantilevered arms 38 mounted to the trolley so that their forward ends, on which a work platform 40 is mounted, can extend towards and retract away from the ship hull, a shroud assembly 42 which substantially completely encloses a volume of space 44 that is confronted by a vertical segment or increment of the ship hull from weather deck to keel (and which typically is twenty feet horizontally long, longitudinally of the ship), an air movement control system 46 for controlled ventilation of the enclosed space; and a power system 48, for operating the trolley, extending and retracting the work platform, and adjusting the forward margin of the shroud to keep it close to the hull along the leading and trailing vertical edges of the particular hull segment being worked on.

Of course, despite the fact that the device 32 has been developed to facilitate the conducting of surface preparation abrading and spray painting operations, additional, or other operations could be conducted within the space 44, using the device 32 as a protective enclosure.

By preference, the tower 34, is a portable framework of struts, ties, braces, connectors and other elements which can be removably secured together so as to provide a unit of the required height to permit access to the whole of the height of a given ship's side, from the height of the weather deck, down to the keel. Of course, in the instance of a yard which anticipates only working on one size of hull for the whole of the working life of a device 32, the tower could be permanently secured together, e.g., by flame-cutting of plates, extrusion of long members, welding of joints, etc. In general, the tower 34 may be made of steel or aluminum, and in substantially the same way and of the same elements and materials, as are conventionally used in the manufacture of elevators used at building construction and retrofitting sites for conveying workers and/or materials to various floors of the building.

A cage, car or elevating trolley 36 is mounted to the tower 34 (e.g., by opposed sets of flanged wheels 50 which roll on vertical tracks 52 provided by respective elements of the tower 34).

The trolley is suspended in the tower 34 for elevation, by cables 54 which connect to the trolley at 56 and, to the drum of a hydraulic winch 60. The connection mechanism 56 each are provided in the form of a spring-loaded ratchet lever 62 which seats in a respective notch 64 in a vertical rail 66 of the tower 34, unless and only for so long as there is lifting tension drawn on the lifting cables 54. Where safety regulations provide otherwise, the trolley may be suspended in the tower using counterweighted cables, other braking or locking systems, redundant cabling, and/or similar conventional means for preventing the trolley from suddenly or unexpectedly dropping due to mechanical or power failures.

It should now be noticed that, whereas various ties and braces preferably are provided around the rear and sides of the tower, the tower front, which, in use, faces the ship side, is substantially open and unobstructed at 68, from the level of the ship's weather deck, down to the keel (i.e., over the full height of the increment of the ship that will need to be worked on using the device 32.

Both of the rear internal corners of the trolley 36 are provided with respective vertical axles 70 on which are journalled for rotating the rear ends of respective cantilevered arms 38. By preference, each arm 38 comprises a rear section 72, hinged at its forward end to a forward section 74 by a vertical axle 76, and each forward section 74, at its forward end is provided with a vertical axle 78. A work platform 40 is mounted to the forward ends of the arms 38, by the axles 78. Accordingly, the arms 38 are articulated by the joints 70, 76 and 78 between the trolley and the work platform, so that they can extend and retract the work platform horizontally (transversally, laterally) relative to the vertical axis of the tower, for moving the work platform towards and away from the longitudinal centerline of the hull. In use, the work platform, as a result, can be retracted as the elevator is raised or lowered, in order to avoid bumping into the hull, and may be extended further as the trolley is lowered, so that the workers riding on the work platform can maintain their close proximity with the exterior of the hull, despite the fact that the width of the hull decreases with height throughout at least a part of the height of the ship.

By preference, three double-acting hydraulic cylinders are provided for coordinately operating the arms 38. These include two extensible-retractable piston-cylinder arrangements 80 respectively connected between central locations on the rear interior of the trolley 36, and intermediate locations along the rear sections 72 of the arms 38 on medial sides of the sections 72, by respective vertical axis pivot joints 82, and one extensible-retractable piston-cylinder arrangements 84 respectively connected between intermediate locations along the rear sections 72 of the arms 38 on lateral sides of the sections 72, and intermediate locations along the forward sections 74 of the arms 38 on lateral sides of the sections 74 by respective vertical axis pivot joints 86 (so that the "knees" at 72-76-74 bend towards one another as the work platform is retracted).

Of course, the arms could be operated manually, or, more elaborate means could be provided for coordinating extension and retraction of the cylinders.

The work platform is retracted by coordinately retracting the piston-cylinder arrangements 80 and 84, and extended by coordinately extending the piston and cylinder arrangements 80 and 84.

The work platform may be configured as necessary (e.g., as to whether it has seats, handholds, rails). At its most basic, it includes a support 40 capable of supporting at least one, and preferably two side-by-side human workers. A typical work platform is on the order of sixteen feet (4.9 m) wide (lengthwise of the ship), and two feet (0.6 m) deep (widthwise of the ship). Similar support for a robotic device instead of or in addition to one or more human workers is within the contemplation of the invention.

The shroud assembly 42 may be comprised of several components, all of which cooperate to define (together with a respective increment 88 of the exterior of a side 18 of the hull, typically from weather deck to keel and about twenty feet (6.1 m) long, longitudinally of the hull), an enclosed space 44 within which work on the increment of the exterior of the hull can be conducted.

Thus, one necessary component of the shroud assembly 42 is one for confining the rear side of the space. This component may conveniently be provided by securing panels of clear corrugated fiberglass-reinforced plastic siding 90 to the outsides of the rear, fore side, aft side and top of the tower. In use, the fiberglass-reinforced plastic panels 90 may have shorter lives than the tower, and be subject to localized replacement as they wear through or otherwise become too worn.

The other major components of the shroud assembly 42 are side curtain assemblies 92. Each side curtain assembly 92 includes a respective curtain 94, which may be made of canvas, and spreaders 96 provided as vertical axis forward, extensions of the tower at the top and base of the tower; these usually respectively project obliquely towards fore and aft (as been seen in FIG. 3), so that the space 44 broadens from the tower towards the hull. An alternative such as Herculite® flexible sheeting material may be used in place of standard marine quality canvas. Each curtain 94 may be made of one piece, or of several pieces laced, shock corded grommeted, Velcro fastened or otherwise secured to one another. Similar securement means (lacing, shock cords, Velcro tabs, etc.) are used at 98 to removably secure the rear edge 108 of each curtain to the respective spreaders 96, and to the front legs 100 of the tower 34, from tower base to tower top, and across in front of the tower top to provide a continuation at 102 of the top wall 104 of the tower 34. In fact, in FIG. 3, the two side curtains are shown somewhat overlapped at the middle of the top 102, with the ends 110 shock corded at 106 to the respective upper spreaders 96.

The front margins 112 of the curtains 94 are preferably provided with a series of electromagnets or permanent magnets 114 sewn or otherwise secured to them (much as is conveniently done to the lower hem of a conventional bath tub shower curtain liner) for permitting the front edges of the curtains 94 to be adjustably held close against the vessel hull at the longitudinal extremes of the hull segment being enclosed by the device 32. The strength and placement of the magnets will need to depend on the weight of the curtain, and the winds locally expected to be encountered which the ship is being worked on. The virtue of electromagnets is that they can be turned off to disconnect them when the device 32 is to be moved.

The curtains 94 may be provided so as to be adjusted entirely manually, or, by preference, manual adjustment may be supplemented one or more hydraulically actuated batwing skeleton-like structures 116 secured to the respective curtains 94, and mounted at rear edges to the front legs 100 of the tower. The hydraulic piston-cylinder assemblies 118 of these structures 116 are extended to extend the curtains forwardly, and retracted so as to buckle the structures 116 and, thus, retract or facilitate retraction of the curtains. By preference, the structures 116 are somewhat flexible, and mechanically latch in an extended condition (much as does the metal framework of an umbrella), so that hydraulic pressure is not necessarily relied-upon to maintain the structure 116 in their extended condition.

Figure 8:
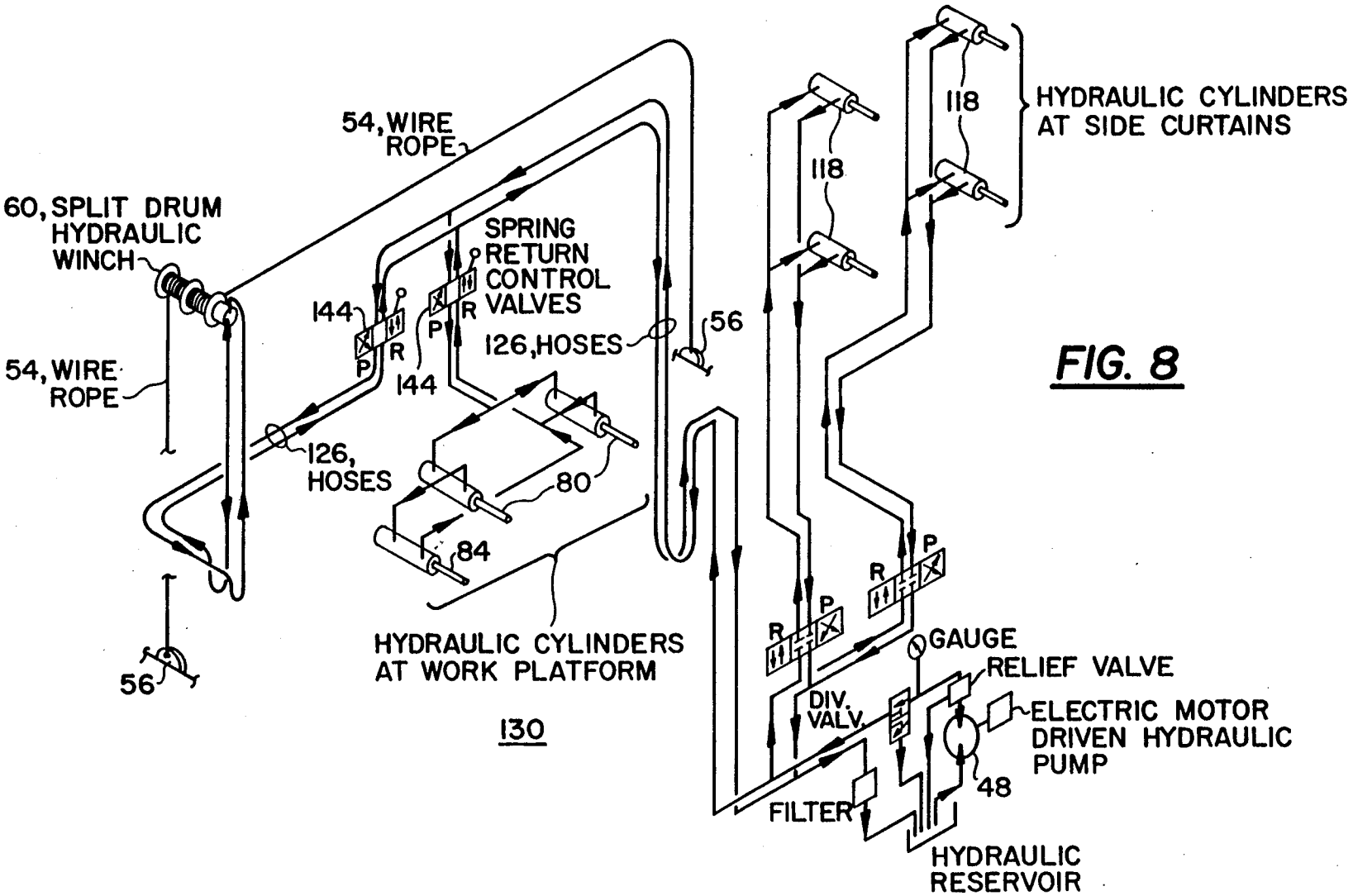
FIG. 8 is a schematic diagram of the hydraulic power system for the device.

A typical electrohydraulic system for operating the hoist, extension and retraction of the work platform, and the curtain-spreading skeletal structure 116 is illustrated at 130 in FIG. 8.

The final major component of the device 32 to be described is the air movement control system 46. At its simplest, this system is shown including a set of dome-lidded air inlet vents 120 provided in the top 104 of the tower (through the shroud assembly 42, into the enclosed space 44), and through a lower lip area 122 (where the two shroud curtains 94 overlap and are overlapped and secured together, e.g., by shock cords, to close the space 44 between the bottom 124 of the ship hull at the base of the side 18) out of the enclosed space 44 by a flexible hose 126 leading into the suction side of a forced air dust collector 128 (which may be visualized as being an industrial-strength vacuum cleaner, of conventional construction. Actually, it may include a bag house, cyclone separator, grit/paint separation facility (for grit reclamation, if feasible), a scrubber and/or a burner for incinerating VOCs.

The bottom four corners of the tower 34 are preferably provided with height adjustable leveling jacks 134, with foot pads 136 which rest on the pontoon deck 12 of the dry dock 14, and the top of the tower 34 is provided with a sling 138, e.g., made of wire rope, which can be hooked by the crane 20 for lifting the device 32 and moving it longitudinally fore or aft to a succeeding increment of hull.

The typical full extent of the path of extension-retraction of the work platform relative to the trolley is ten feet (3 m).

The tower 34 preferably is fabricated in modules of framework, such that for each job, the tower can be shortened or heightened, as necessary, typically in ten foot (3.0 m) segments.

Figure 3:
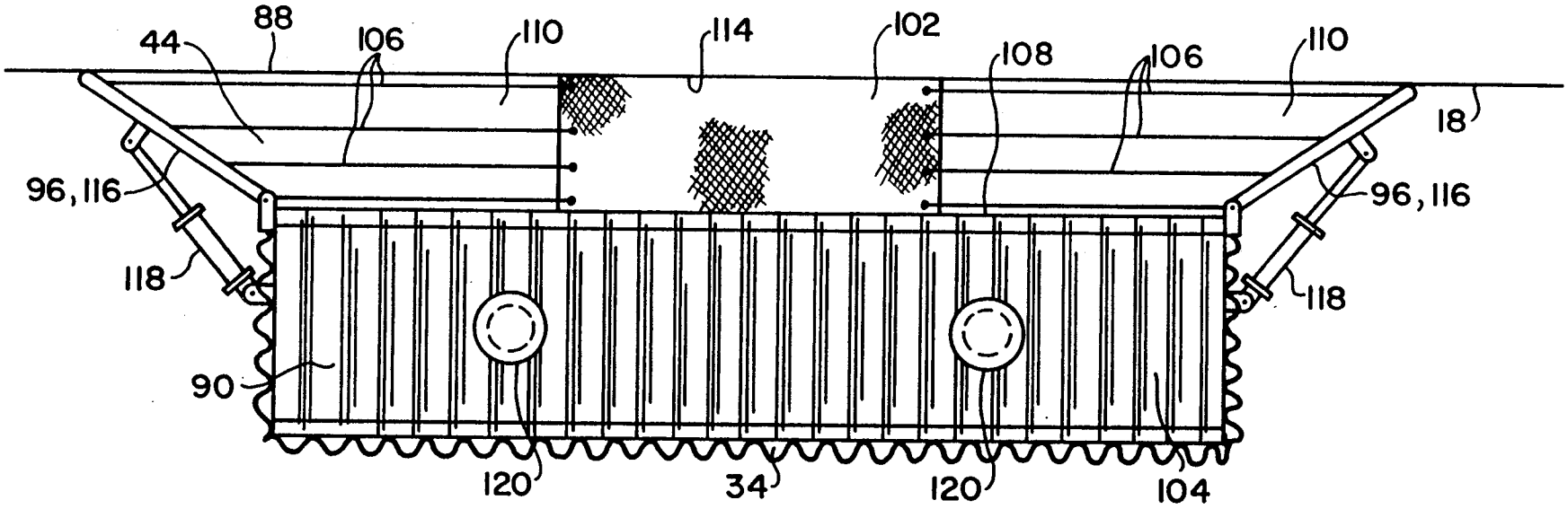
FIG. 3 is a top plan view of the tower and shroud structure thereof.
Figure 4:
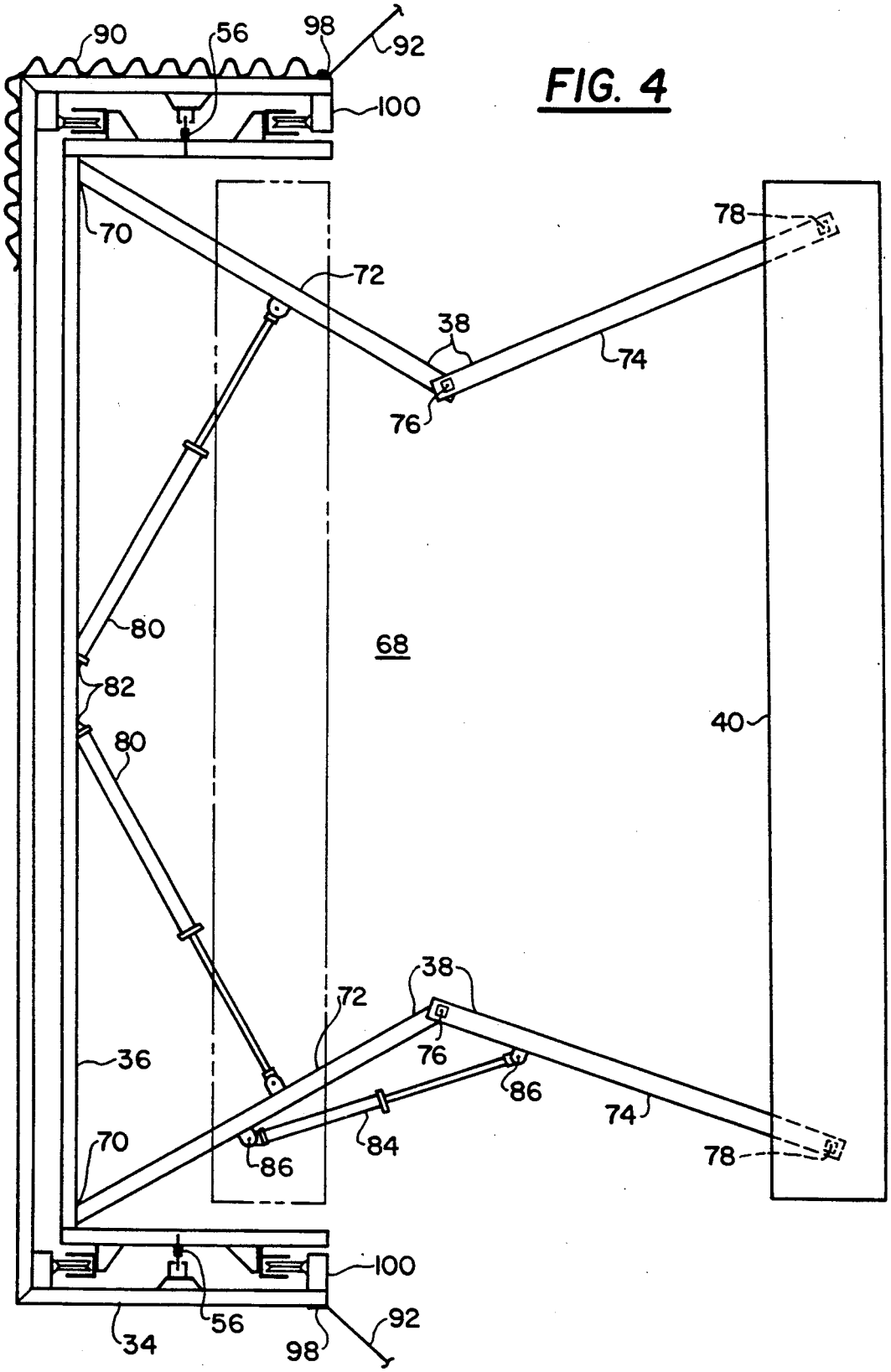
FIG. 4 is a downward-looking transverse sectional view thereof, taken at a level below the hoist but above the trolley, showing the cantilevered arms supporting the work platform at a variably transversally extended position relative to the tower.
Figure 5:
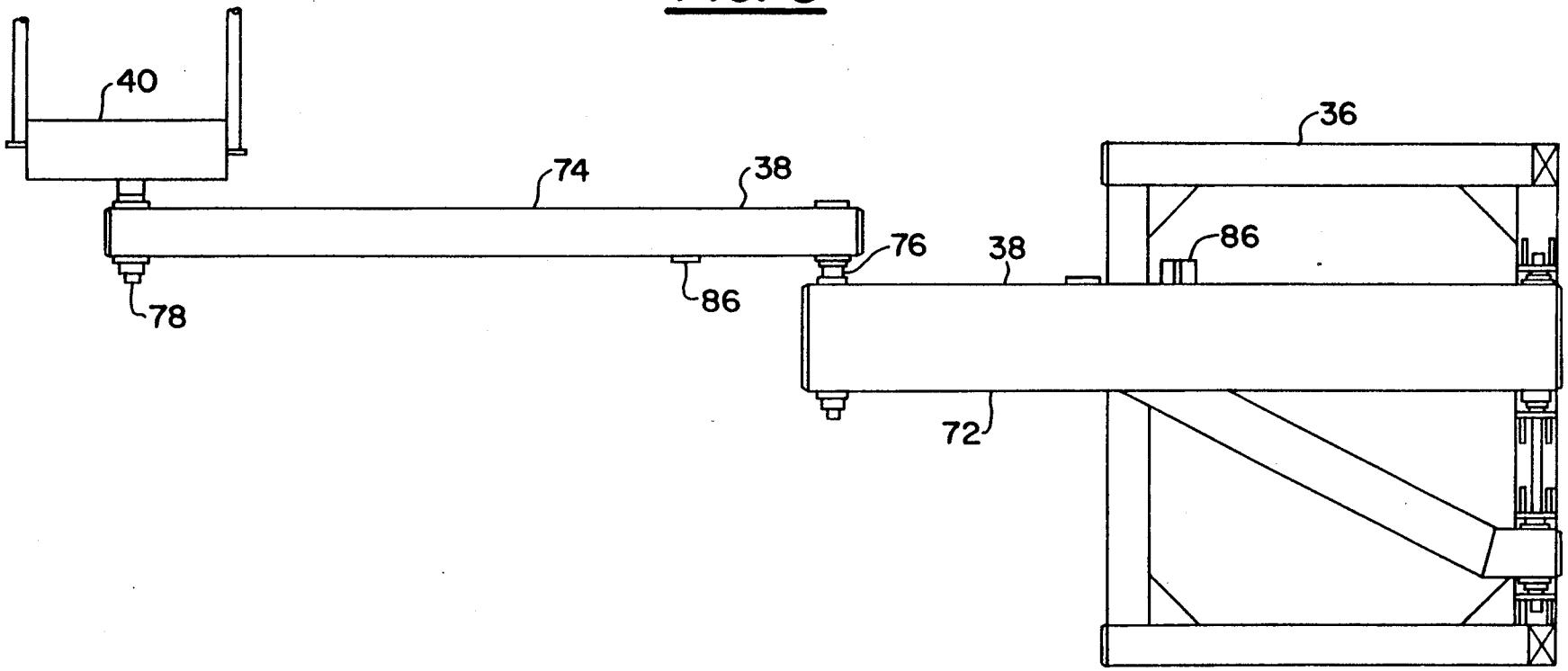
FIG. 5 is a side elevational view of the structure shown in FIG. 4, with the trolley in longitudinal section.
Figure 6:
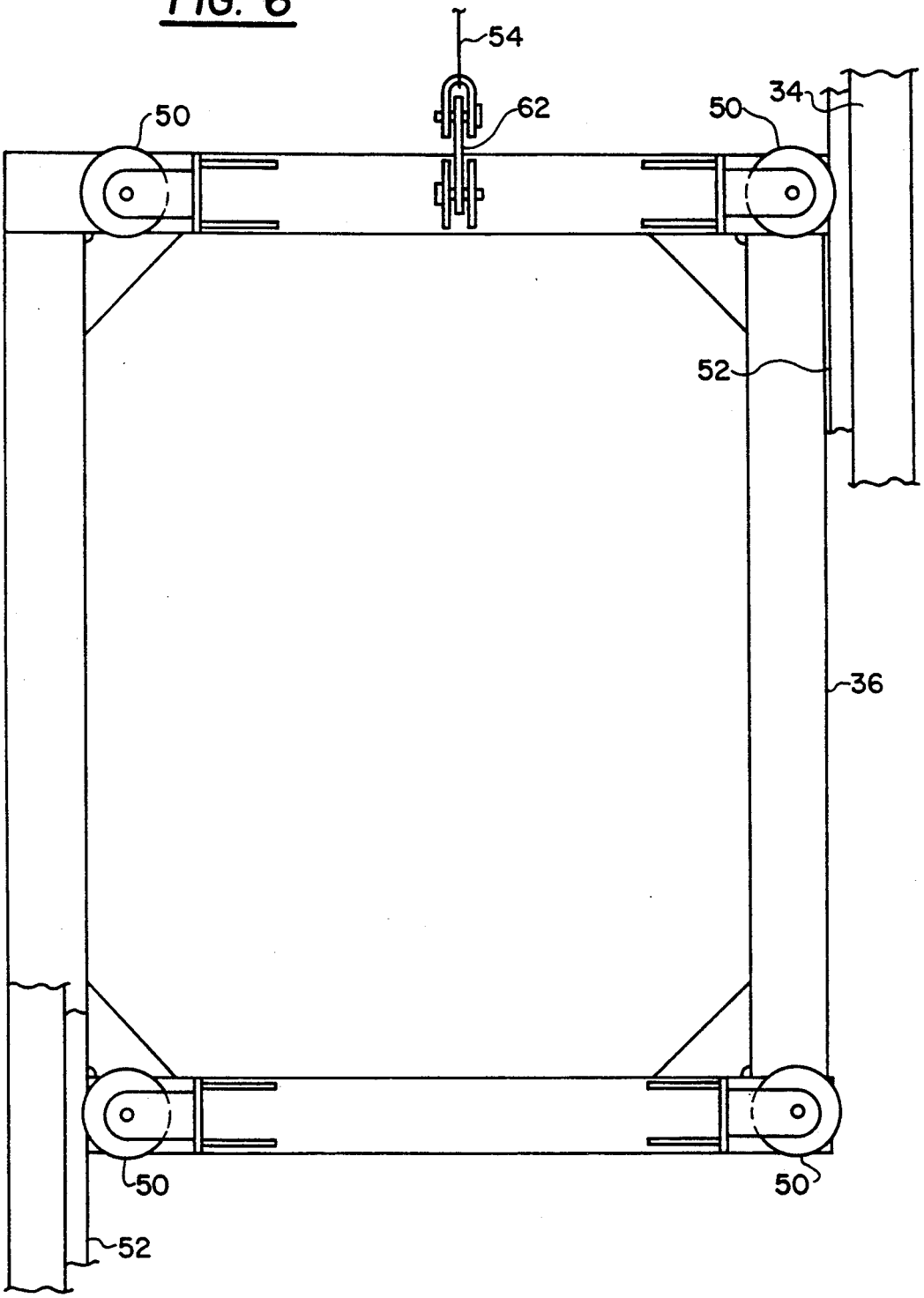
FIG. 6 is a side elevation view of the trolley, with the arms omitted, showing the relation of the trolley to the frame.
Figure 7:
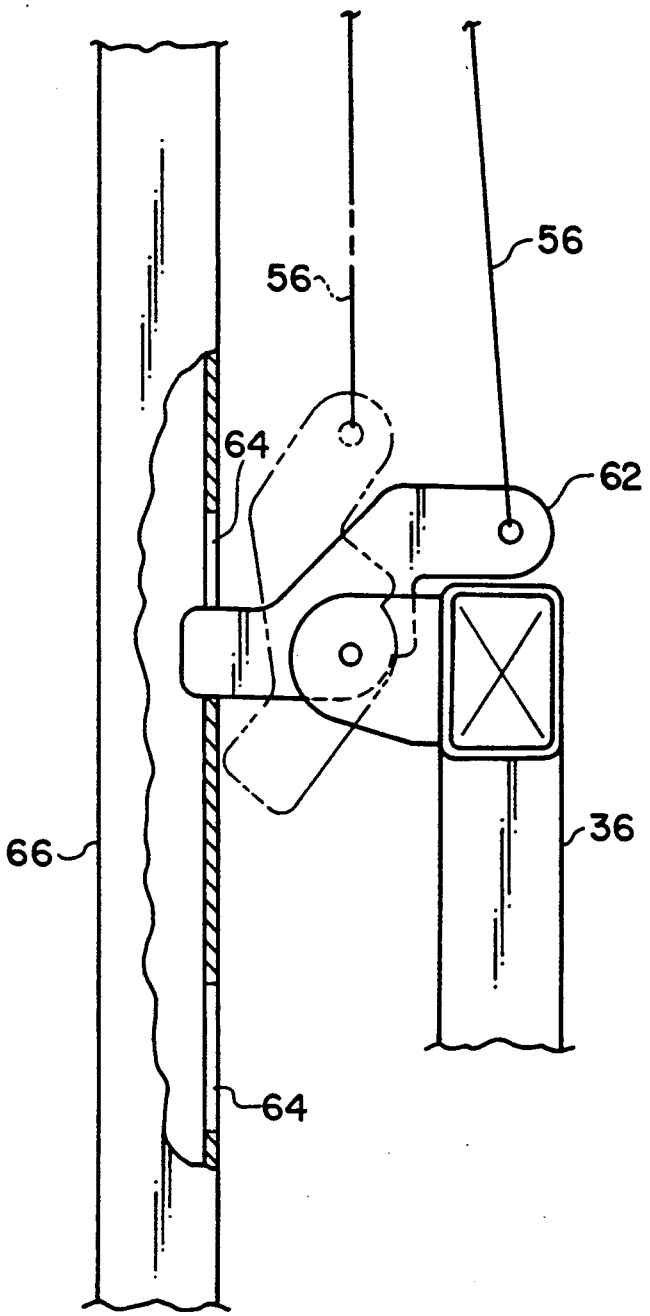
FIG. 7 is a fragmentary elevational view, with some parts cut away and sectioned, showing one of the preferred safety ratchet assemblies for each of the two lift points for the trolley.

In a typical use of the device 32, it is set up relative to a ship hull increment as shown in FIGS. 1-3. Then, two abrasive-blasting workers enter the enclosed space 44 with their abrasive blasting hoses and nozzles 140, which are connected to externally sited conventional abrasive-blasting supply machines 142.

The abrasive blasters raise the trolley 36, and thus, the platform 40 to its uppermost position using the work platform controls 144 and begin the abrasive blasting process. They work downward, blasting a twenty-foot (6.1 m) wide vertical swath for the full ship height, lowering and extending the work platform using the work platform controls 144, as necessary, to facilitate access to the hull of the ship. This process takes approximately one shift.

One paint-spray worker then enters the work platform and (using conventional paint-spraying apparatus having a hose and nozzle 146 within the space 44 but a supply machine 148 located outside the space 44) paints the area just blasted by the abrasive-blasting workers operating the work platform in a like manner. This process takes approximately four hours.

Laborers then shovel/sweep up the spent abrasive on the dry-dock floor within the enclosure. This spent abrasive is placed into suitable containers for disposal and/or recycling as desired. Meanwhile, rigging workers attach the crane 20 to the tower sling 138 and move the enclosed staging device 32 to the next desired location along the ship's hull so the above process can be started again the next day on a respectively successive increment.

This detailed description concludes with a summarization of some important performance advantages that the apparatus and method of the present invention provide, particularly relative to the present conventional use of workers using wheeled, hydraulically operable manlifts:

Unlike manlifts which cannot readily be enclosed without becoming practically ineffective, this staging device will completely enclose a volume sufficient for two blasters to work at maximum efficiency for a full work shift.

The staging device is small enough to fully enclose the space between itself and the ship using nonporous materials without risking wind damage.

A sufficient number of these enclosed staging devices can be acquired and progressively relocated around the ship to permit the coating process to be accomplished in time spans as short or shorter than currently conventionally necessary.

Moved by dry-dock cranes in twenty-foot increments along the length of the ship, the enclosed staging device provides full worker access to all areas of the outer hull of any ship regardless of length, depth or hull contour. The device is designed to raise and lower its platform with an electrical hydraulic winch and, at the same time, extend its platform hydraulically any distance between zero feet and ten feet to respond to shape changes at different vertical heights. To respond to compound shape changes in the hull in a longitudinal direction, the device preferably has the capability to hydraulically extend each end of its platform a different length.

(In the rare instance where the hull distance from the ship's fore and aft centerline at a given fore and aft location reduces by more than ten feet between the weather deck and keel, preventing workers on the device from reaching all the hull at lower heights, a second, shorter (but similar) staging device could be used and placed inboard of the first enclosed staging device. Such extreme contours involve areas of the hull in immediate proximity to the bow and stern. These areas comprise a very small percentage of hull surface areas and therefore, are also candidates for blasting by other less efficient means such as vacuum blasting.)

The enclosed staging device is expected to experience significantly fewer maintenance problems than the manlifts most widely used currently for abrasive blasting and painting. Therefore, maintenance costs, equipment downtime, worker disruption and lost time are expected to be reduced. Some reasons for this expectation are as follows:

Both the enclosed staging device and manlifts use hydraulic cylinders exposed to abrasive dust and paint overspray. Maintenance in this area is predicted to be comparable.

However, manlifts use internal combustion engines with air intakes and other mechanical components fully exposed to damage from abrasive dust and paint overspray. The enclosed staging device uses inherently lower-maintenance electric motors, which are, in addition, completely outside the enclosed area, and therefore, not exposed to abrasive dust and paint overspray.

In addition to hydraulic cylinders, manlifts have significant mechanical components utilized to elevate and rotate the hydraulic arm as well as move the manlift carriage along the dry-dock floor. These mechanical components are fully exposed to abrasive dust and paint overspray. The enclosed staging device has no critical mechanical components within the enclosure exposed to abrasive dust and paint overspray.

Manlifts have carriages which ride on four wheels with pneumatic tires, which experience frequent flat tires in the dry-dock environment, with accompanying repair expense, worker lost time and disruption. Moving the enclosed staging devices by dry-dock crane will avoid such problems.

The internal combustion engines of manlifts must be fueled daily, with associated labor costs, downtime, fire/explosive hazards and fuel spillage which ultimately contaminates the usually adjacent body of water. The preferably electric motors of the enclosed staging devices have none of these problems.

Manlift maneuvering is a major cause of wear and tear of the dry-dock floor coating, because the pneumatic tires are often rotated in place (i.e., spun) atop spent abrasive on the dry-dock floor. Movement of the enclosed staging devices by dry-dock crane will eliminate this cause of wear and tear.

Most important, however, is the fact that the enclosed staging device effectively confines the abrasive dust and overspray to a small volume and space immediately adjacent to the hull of the ship where it can be collected (and recycled or incinerated as appropriate)

more efficiently and before they impact the atmosphere, the proximate body of water, ship's mechanical equipment, dry-dock cranes, ancillary blasting and coating mechanical equipment and concurrent ship repair work as well as cars, boats and houses owned by the public. Abrasive blasting and painting using manlifts offers no effective solution to these problems.

The relatively small volume enclosed by the enclosed staging device and ships hull offers opportunities for environmental control not feasible by any of the enclosure approaches available for manlifts. This includes dust collection, humidity control, temperature control and protection from rain and snow. These factors are all vital to coating quality and life. In addition, it should be possible to conduct abrasive blasting and painting under weather conditions (rain, snow, cold) which would halt abrasive blasting and painting from conventional staging and manlifts.

It should now be apparent that the apparatus and method for performing external surface ships' hulls as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for servicing a generally vertical surface of substantial horizontal extent, comprising:

(a) selecting an increment of the surface having a given horizontal extent which is less than said substantial extent, and a given vertical extent which ranges downwards to adjacency with a generally horizontal platform;

(b) arranging a generally vertical tower on the platform in confronting relationship to, but spaced from said increment of the surface, said tower having supported thereon a trolley which can be raised and lowered on the tower so as to place the trolley selectively in confronting relation with any selected horizontal strip of said increment, and said trolley having provided thereon a work platform cantilevered from the trolley towards the surface, on an arm structure which permits the work platform to be extended towards and retracted away from the surface;

(c) forming a curtain-enclosed space which includes said tower and said increment of said surface, with said work platform thereby being enclosed with said space;

(d) while supporting at least one work-performing operator on said work platform, causing said operator to successively apply work to a plurality of said bands of said increment of said surface, and, in conjunction therewith, adjusting said arm structure for adjusting the proximity of said operator to said increment of said surface.

2. The method of claim 1, wherein:

said surface is on a hull of a ship and said operator is an abrasive blaster who successively abrasively blasts material from said hull.

3. The method of claim 2, wherein:

said ship has a weather deck disposed at a first, higher level and a keel disposed at a second, lower level, and said abrasive blaster begins near the level of the weather deck of the ship and progressively works down to near the level of the keel of the ship.

4. The method of claim 3, wherein:

the hull slants or curves inwards, away from the tower, in at least a portion thereof near the keel of the ship, so that the operator must progressively extend the arm structure when progressing from band to band on each of several bands near the lower extent of the increment.

5. The method of claim 4, further comprising:

(e) after steps (a)-(d) have been performed, step (d) is repeated by a painter who successively applies paint to said surface.

6. The method of claim 5, further comprising (f) after steps (a)-(e) have been conducted, moving said tower along said horizontal platform to a new location and repeating steps (a)-(e) on a different-selected increment.

7. The method of claim 6, wherein:

step (f) is conducted a sufficient number of times as to cause said hull to become substantially completely externally abrasive-cleaned and painted.

8. The method of claim 5 further comprising:

continuously drawing air into said space, and out of said space into an air-cleaning device while conducting steps (d) and (e), in order to capture airborne abraded-off debris, paint overspray and volatile organic compounds for removal from air to be exhausted from the space.

9. The method of claim 6, further comprising:

continuously drawing air into said space, and out of said space into an air-cleaning device while conducting steps (d) and (e), in order to capture airborne abraded-off debris, paint overspray and volatile organic compounds for removal from air to be exhausted from the space; and between steps (e) and (f), cleaning particulate debris from said horizontal platform within said space.

10. The method of claim 1, wherein:

at least one said operator is a human, and, while performing step (d), said human raises and lowers said trolley on said tower and extends and retracts said arm structure for extending and retracting said work platform.

11. The method of claim 10, wherein:

said work platform has two laterally opposite ends, and said human, while extending or retracting said arm structure, cocks said platform so that one end of said work platform is further than is the other end of said platform, from said tower.

12. The method of claim 1, wherein:

said surface is provided on a ferromagnetic substrate and at least portions of said curtain are flexible and, as part of step (b), forward edges of flexible portions of said curtain are adhered by magnets provided thereon, to said substrate.

13. The method of claim 12, wherein:

said substrate is a hull of a ship.

14. The method of claim 13, wherein:

the hull slants or curves inwards, away from the tower, in at least a portion thereof near the keel of the ship, so that the operator must progressively extend the arm structure when progressing from band to band on each of several bands near the lower extent of the increment.

15. The method of claim 6, wherein:

the tower has a plurality of feet provided with leveling jacks, and as part of at least one conducting of step (b), the leveling feet are adjusted for bringing the tower to a more vertical orientation on said horizontal platform.

16. The method of claim 15, wherein:

said horizontal platform is a pontoon deck of a dry dock and step (f) is conducted using a crane of said dry dock for lifting moving and setting down said tower at said new location.

17. A device for use in applying work to a generally vertical surface of substantial horizontal extent, having a generally horizontal platform arranged therebeside, comprising:

a generally vertical tower arranged to be supported on said platform in confronting relationship to, but spaced from a selected increment of said surface which has a given horizontal extent which is less than said substantial extent, and a given vertical extent which ranges downwards to adjacency with said platform;

said tower having supported thereon a trolley which can be raised and lowered on the tower so as to place the trolley selectively in confronting relation with any selected horizontal strip of said increment;

said trolley having provided thereon a work platform cantilevered from said trolley towards the surface, on an arm structure which permits the work platform to be extended towards and retracted away from the surface;

a curtain assembly supported on said tower for forming an enclosed space which includes said tower and said increment of said surface, with said work platform thereby being enclosed within said space; and first power means operatively connected with said trolley and second power means operatively connected with said arm structure, respectively, for raising and lowering said trolley and extending and retracting said work platform.

18. The device of claim 17, further comprising:

means for continuously drawing air into said space, and out of said space into an air-cleaning device.

19. The device of claim 17, further comprising:

control means located on said work platform for actuating said first and second power means.

20. The device of claim 19, wherein said first and second power means respectively comprise a hydraulically operated winch and a set of hydraulically operated extensible-retractable piston and cylinder assemblies.

21. The device of claim 20, wherein:

said winch and said assemblies have hydraulic systems powered by pump means that in turn are powered by electric motor means which are located outside said space.

22. The device of claim 19, wherein:

said platform has two laterally opposite ends; and said control means are constructed to be operable for cocking said work platform, so that either end of said work platform can be positioned further from said tower than the respective other of said ends thereof.

23. The device of claim 17, wherein:

at least portions of said curtain assembly are constituted by flexible side curtains having forward edges; and said forward edges are provided with magnet means for adjustably securing said curtains on said surface.

24. The device of claim 23, wherein:

said curtain assembly further includes extensible-retractable stiffener means secured as a skeleton on said curtains and to said tower; and said device further includes third power means operatively connected with said stiffener means for extending said forward edges of s id curtains towards said surface and retracting said forward edges of said curtains away from surface.

25. The device of claim 17, further comprising:

said tower having a plurality of adjustable jacking means which serve as respective feet for said tower, whereby said tower can be adjusted on said platform for greater verticality; and said tower is provided with connector means arranged to be engaged by a crane for lifting said device, moving said device into confronting relation with a different increment of said surface, and at such a place, setting said device down onto said platform.

26. The device of claim 17, further including:

an abrasive blasting machine located outside said space, and having an output hose extending into said space to serve a nozzle supported on said work platform.

27. The device of claim 17, further including:

a paint spraying machine located outside said space, and having an output hose extending into said space to serve a nozzle supported on said work platform.

* * * * *